US005890388A

United States Patent [19]

Gerenser et al.

[11] Patent Number: 5,890,388

[45] Date of Patent: Apr. 6, 1999

[54] METHOD AND APPARATUS FOR FORMING STRUCTURAL MEMBERS

[75] Inventors: Duane E. Gerenser, New Hope; Reinhard F. Kuffel, Washington Crossing, both of Pa.

[73] Assignee: Centre Bridge Investments, Trenton, N.J.

[21] Appl. No.: 902,884

[22] Filed: Jul. 30, 1997

[51] Int. Cl.[6] ..... B21D 5/08; B21D 7/16

[52] U.S. Cl. ..... 72/177; 72/202; 72/377; 72/342.94

[58] Field of Search ..... 72/177, 178, 202, 72/377, 342.94, 342.96

[56] References Cited

U.S. PATENT DOCUMENTS

| | | | |
|---|---|---|---|
| 3,228,220 | 1/1966 | Schneckenburger . | |
| 3,630,059 | 12/1971 | Henkel | 72/177 |
| 3,988,914 | 11/1976 | Metcalfe | 72/202 |
| 4,433,565 | 2/1984 | Preller | 72/177 |
| 4,838,062 | 6/1989 | Prenn . | |
| 4,906,809 | 3/1990 | Workman . | |
| 5,042,281 | 8/1991 | Metcalfe . | |
| 5,228,324 | 7/1993 | Frackiewicz et al. . | |
| 5,306,365 | 4/1994 | Reighard . | |
| 5,359,872 | 11/1994 | Nashiki . | |
| 5,435,162 | 7/1995 | Caudill et al. . | |
| 5,454,888 | 10/1995 | Gallagher, Jr. . | |

FOREIGN PATENT DOCUMENTS

| | | | |
|---|---|---|---|
| 32401 | 2/1991 | Japan | 72/177 |
| 60802 | 3/1991 | Japan | 72/177 |
| 15301 | 1/1994 | Japan | 72/177 |
| WO96/02333 | 2/1996 | WIPO | 72/177 |

*Primary Examiner*—Daniel C. Crane
*Attorney, Agent, or Firm*—Mathews, Collins, Shepherd & Gould, P.A.

[57] ABSTRACT

A method and apparatus for forming structural members from a substrate heats a middle portion of the substrate in combination with edge guide rolls for laterally displacing mass of the substrate. Top and bottom rolls shape the structural member into the desired shape. The entire substrate is annealed. Thereafter, additional roll passes can be used for improving the shape of the substrate to the desired shape.

15 Claims, 4 Drawing Sheets

METHOD AND APPARATUS FOR FORMING STRUCTURAL MEMBERS

BACKGROUND OF THE INVENTION

1. Field of the Invention

The present invention relates to a method and apparatus for forming structural members from strips or bars of metal in which heating of the center section of the strip or bar in combination with a precision guide die and roll assembly precisely forms the desired shape.

2. Description of the Related Art

Conventional methods for forming structural members in steel include hot rolling techniques. A typical mill receives billets for rolling into shapes at a temperature above 1800 F. and heats them to a temperature of about 2250 F. A structural member having an angle shape can be produced in a roll mill in a nine roll pass by the flat and edging method. This method has the disadvantage of causing significant heat loss in the rolling of thin and narrow structural sections. Structural angles and other shapes in stainless steel below about ¼ inch in thickness and six inches in width are extremely difficult to produce using conventional technology. Production of structural angles and other shapes in stainless steel below about ¼ inch in thickness and six inches in width is uneconomical and inefficient.

U.S. Pat. No. 5,435,162 describes a zone heating device for heating the sides of a metal plate during formation of a thickened edge along the edge of the metal plate. An activating means moves a first and second burner relative to the first and second sides of the plate. A forming roll has an axis of rotation transverse to the plate sides for forming the thickened edge.

U.S. Pat. No. 5,454,888 describes a method of warm forming a high strength steel structural member using a starting material of a blank having a tensile strength of at least about 120,000 psi. The high strength steel is formed of carbon and manganese. The stock is warm formed to a temperature of about 800 F. through a tapered die.

U.S. Pat. No. 4,433,565 describes a method for manufacture of a metal profile member by continuously feeding a band along hot shaping and cold shaping procedures. The heating system has the form of a medium frequency induction installation for heating a cross-sectional width of the band at opposite longitudinal edges of the band. The band is passed between pairs of discs disposed on opposite sides of the heated portion. The angle of the discs relative to the band of material is adjusted to cause the heated softened area to be stretched or compacted.

Of general interest are U.S. Pat. Nos. 4,838,062; 4,906,809 and 5,228,324.

SUMMARY OF THE INVENTION

Briefly described the present invention relates to a method and apparatus for forming structural members in which heating of the center section of a substrate formed of a strip or a bar in combination with a guide die and roll assembly followed by annealing and a two or three stand tandem roll mill precisely forms the strip or bar in the desired shape. Preferably, the method and apparatus is used for forming an angle shaped structural member in which additional mass is needed in the center of the substrate for providing the required mass in the apex section of the formed finished product. The heating of the center section of the substrate in combination with a guide roll and die assembly moves metal laterally to the center of the strip. Thereafter, annealing and minimized conventional mill roll passes can be used to form the angle shaped structural member. Zone heating of the center section of the substrate is preferably performed with induction heating or high efficiency gas burner. For forming angle structural members, at least one pair of edge rolls on either side of the substrate press material mass towards the center of the substrate. Top and bottom rolls shape the displaced material for forming an apex at the top surface of the substrate. The present invention has the advantage of reducing the conventional number of roll passes needed for forming structural members. The invention will be more fully described by reference to the following drawings.

DETAILED DESCRIPTION OF THE INVENTION

During the course of this description, like numbers will be used to identify like elements according to the different figures which illustrate the invention.

Figure 1:
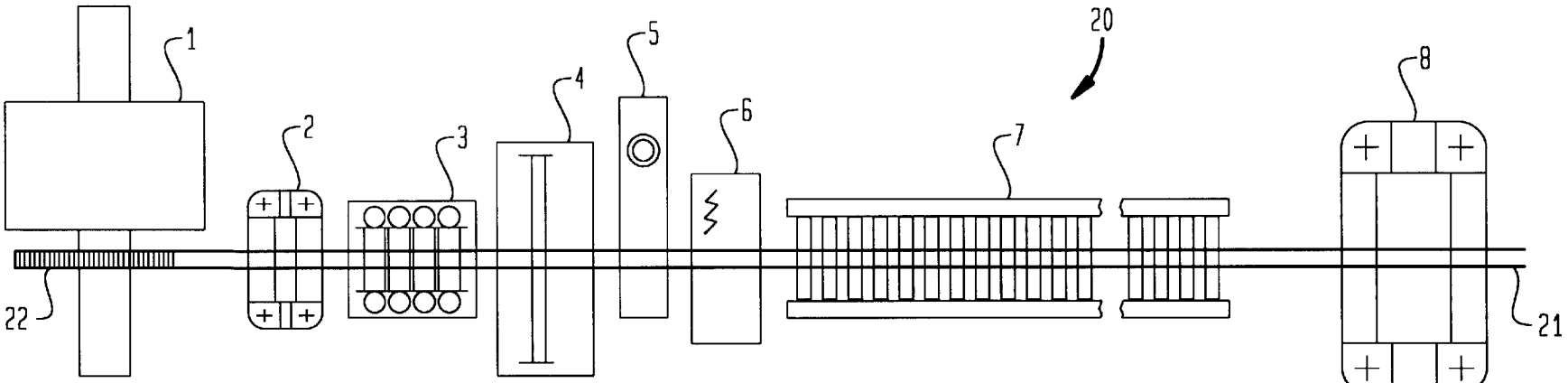
FIG. 1 is a diagrammatic top view illustrating an embodiment of line entry apparatus and operations of the invention.
Figure 2:
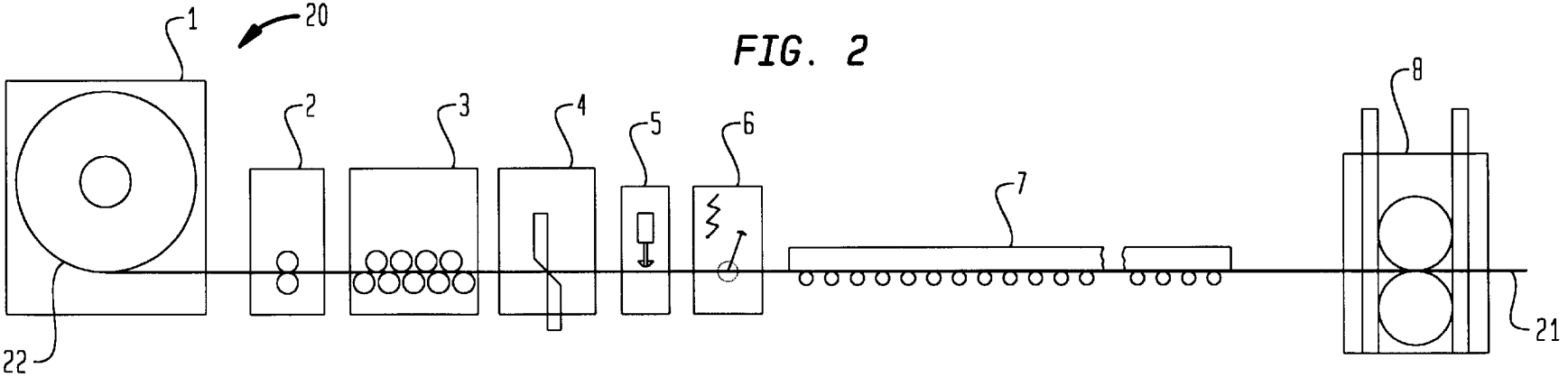
FIG. 2 is a diagrammatic side view of the embodiment of the line entry apparatus and operations of FIG. 1.
Figure 3:
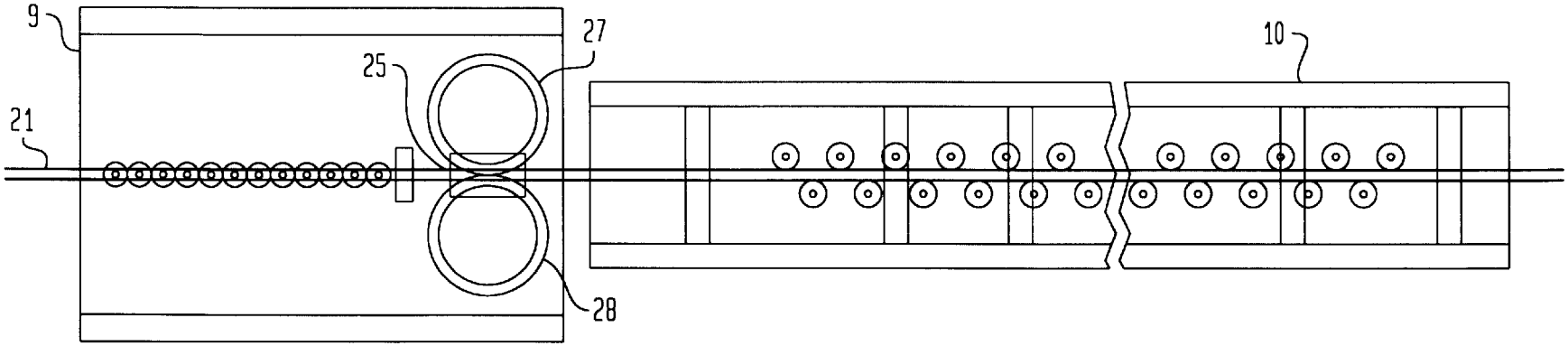
FIG. 3 is a diagrammatic top view illustrating an embodiment of the zone heating, metal displacement and annealing apparatus and operations of the invention.
Figure 4:
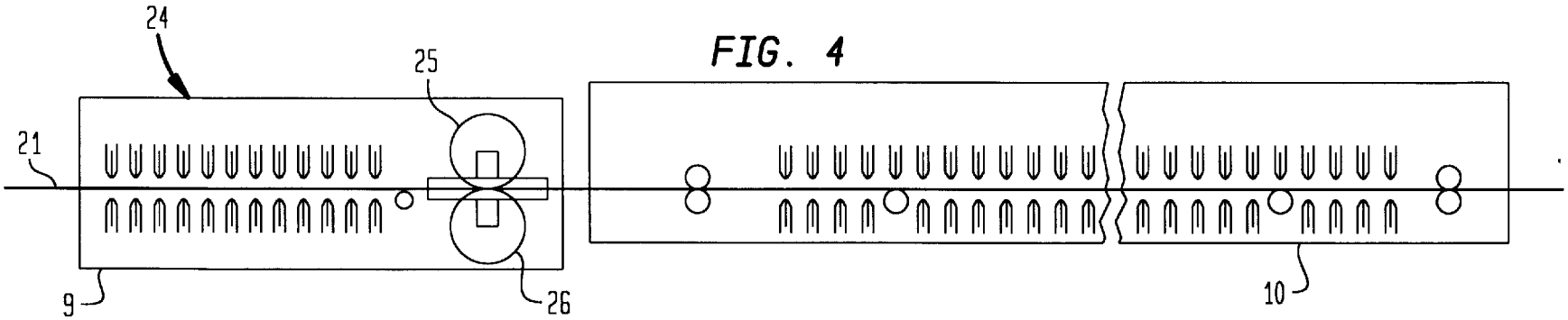
FIG. 4 is a diagrammatic side view of the embodiment of the zone heating, metal displacement and annealing apparatus and operations of FIG. 3.

FIGS. 1 through 9 and 12 through 15 illustrate an apparatus for forming structural members 11 in accordance with the teachings of the present invention. Entry station 20 feeds substrate 21 to zone heating and profile forming section 24 as shown in FIGS. 3 and 4.

Substrate 21 can be strip plate coil or flats sheared from plate and it can be any grade of steel. For example, substrate 21 can be formed of carbon steel or any grade of stainless steel. Typically, substrate 21 formed of a strip plate coil has a thickness of about 0.500 inches or less and a width of about 2.000 inches to about 16.000 inches. Substrate 21 formed of a sheared plate flat bar has a thickness of about 0.500 inches to about 1.500 inches and a width of about 4.000 inches to about 12.000 inches.

Coiled strip plate 22 is continuously uncoiled with strip uncoiler 1 and feed into two high mill roll stand 2. Straightener 3 flattens strip plate 22. Crop shear 4 crops and shears ends of strip plate 22 for precise feeding. End chamfer 5 and butt welder 6 join coils of strip plate 22 for continuous operation. Strip plate substrate is fed to entry roll table 7.

Substrate formed of bar flat can be placed directly on entry roll table 7. Entry roll table 7 feed strip plate or bar flat substrate to temper mill 8. Temper mill 8 preferably includes a pair of mill rolls and one pair of edge rolls for sizing width and thickness of substrate 21 to within 0.001 inch of tolerance precision.

Figure 5:
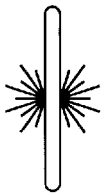
FIG. 5 is a diagrammatic cross sectional view of a substrate during zone heating.

Heater 9 provides zone heating of substrate 21 at a predetermined portion of substrate 21, as shown in FIG. 5. Zone heating is employed by heating at a temperature of about 1800 F. to about 2250 F. for concentrated heating at a predetermined position of substrate 21. Zone heating can be performed by induction heating. Alternatively, zone heating can be performed with high efficiency gas heater, such as manufactured as RAPIDFIRE™ by AirProducts and Chemicals, Inc., Allentown, Pa. For the formation of angle shaped structural members, preferably center of substrate 21 is heated with zone heating. Typically, the center of substrate 21 subject to concentrated heating has a width in the range of about 0.500 inches to about 1.500 inches.

Figure 6:
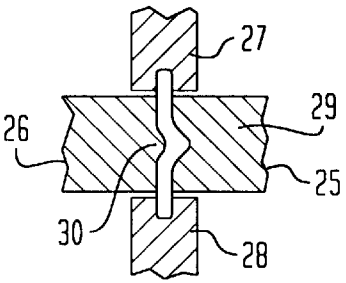
FIG. 6 is a cross sectional view showing preparatory angle shape for motion operations.

Rolls 25 through 28 operate simultaneously on zone heated substrate 21 for shaping substrate 21. For forming an angle shaped structural member, substrate 21 is shaped to have an apex 29 at the top of substrate 21 and a concave bulb recess 30 at the bottom of substrate 21 as shown in FIG. 6.

Preferably, rolls 25 through 28 include at least one pair of edge guide rolls 27 and 28 for pressing the material of substrate 21 toward center of substrate 21 and at least one pair of top and bottom rolls 29 and 30 for shaping substrate 21. Alternatively, a contoured tool die can be used for shaping substrate 21.

After zone heating and profile forming section 24, substrate 21 is received in annealing section 10. Annealing section 10 preferably includes induction annealing furnace and induction radiant soaking zone. Preferably, the annealing furnace provides conventional temperatures for annealing of about 1800–2000 F.

Figure 7:
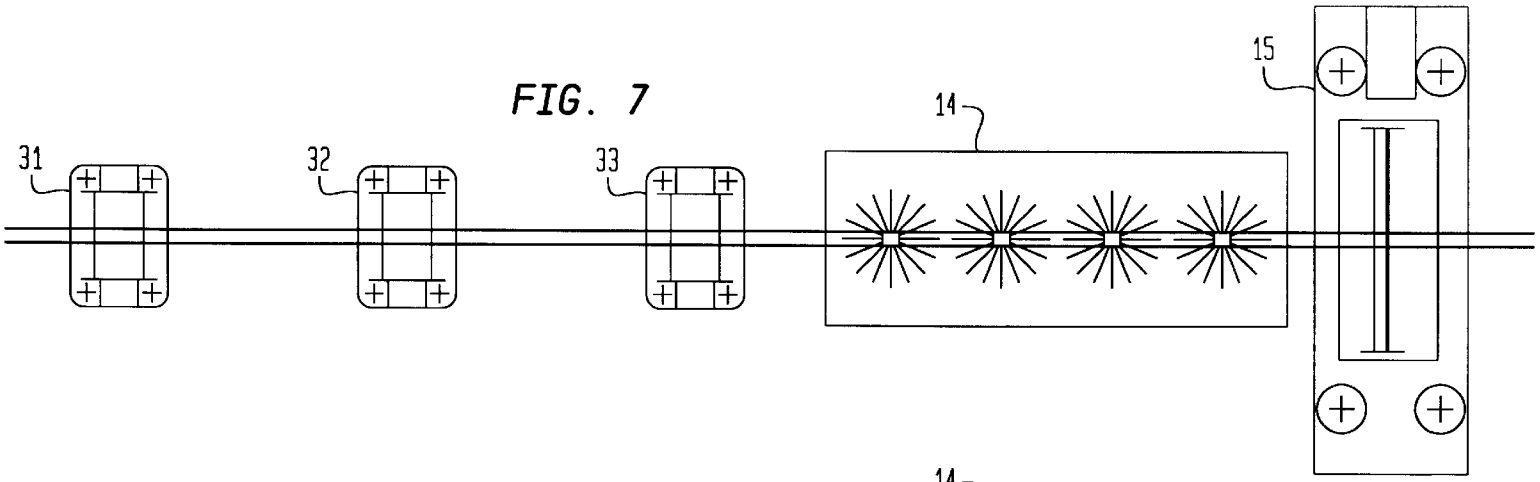
FIG. 7 is a diagrammatic top view illustrating an embodiment of tandem structural roll mill, quenching and shearing apparatus and operations of the invention.
Figure 8:
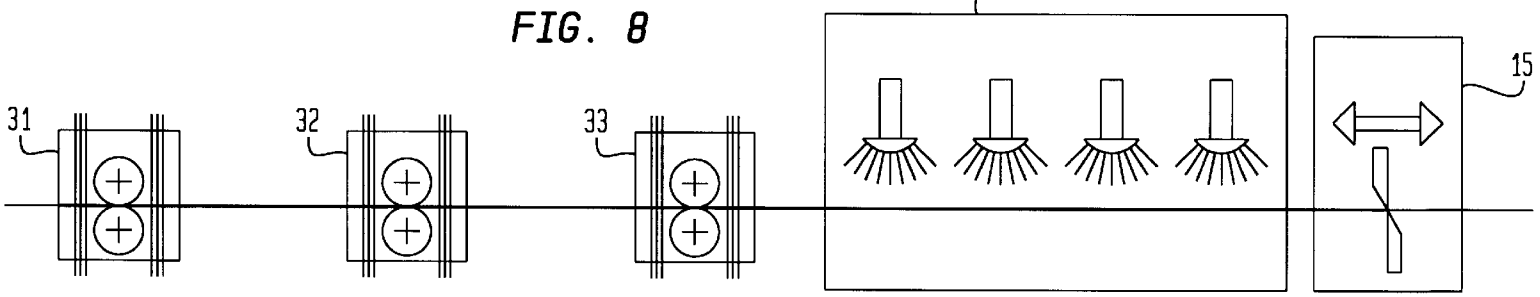
FIG. 8 is a diagrammatic side view of the embodiment of tandem structural roll mill, quenching and shearing apparatus and operations of FIG. 7.
Figure 9:
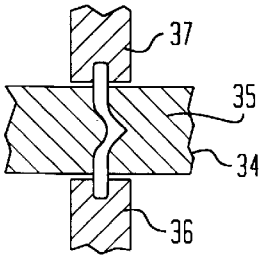
FIG. 9 is a cross sectional view showing a first roll mill apparatus and operation of the tandem roll mill apparatus and operations of the invention.

FIGS. 7 and 8 illustrate tandem roll mill stands 31, 32, and 33 which follow annealing section 10. Preferably, for forming angle shaped structural members by the flat-and-edging method three roll passes are provided by tandem mill stands 31, 32, and 33. Each of tandem mills 31, 32, and 33 include rolls 34 and 35 positioned on top and bottom of substrate 21 to control the contour of substrate 21. Preferably, tandem mills 31, 32, and 33 also include edge rolls 36 and 37. FIG. 9 illustrates substrate 21 after rolling with mill stand 31.

Figure 11:
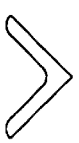
FIGS. 10 and 11 are cross sectional views of metal substrate depicting profiles subsequent to successive roll mill operations of the invention.
Figure 10:
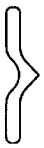

FIG. 10 illustrates substrate after rolling with mill stand 32 to further move mass and create desired shape. FIG. 11 illustrates substrate after rolling with mill stand 33, having completed a precise angled shape.

Substrate 21, now in angled shape from mill station 33 dan be cooled rapidly in quench 14 to prevent carbide precipitation and minimize scale formation. Shear 15 cuts continuous angle shaped substrate 21 to length to become an angled shape of predetermined length. Typical lengths are in the range of about ten to forty feet.

Figure 12:
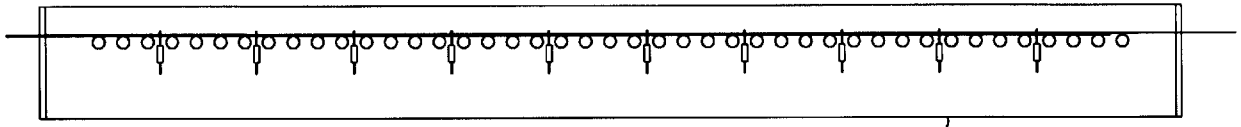
FIG. 12 is a diagrammatic side view illustrating an embodiment of walking beam cooling apparatus and operations of the invention.
Figure 13:
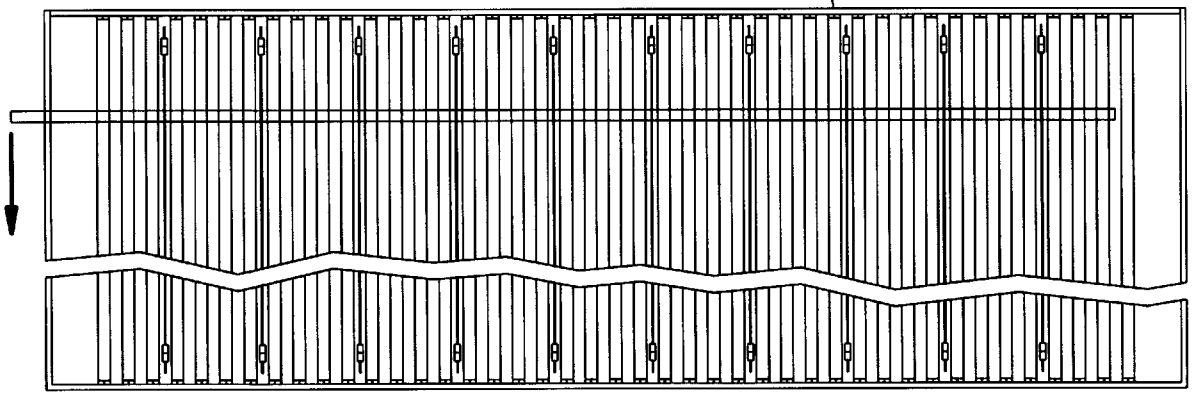
FIG. 13 is a diagrammatic top view illustrating an embodiment of walking beam cooling apparatus and operations of the invention.
Figure 14:
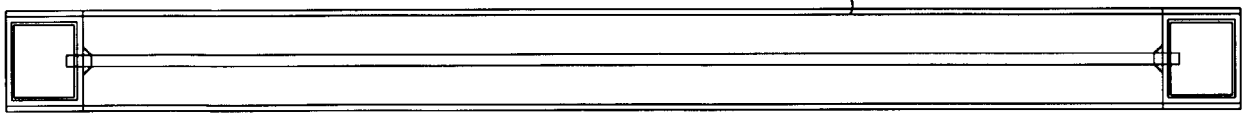
FIG. 14 is a diagrammatic top view illustrating an embodiment of the stretch straightener apparatus and operation of the invention.
Figure 15:
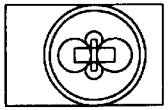
FIG. 15 is a diagrammatic front view of the gripper section of the stretch straightener apparatus and operation of the invention.

FIGS. 12 and 13 illustrate walking beam cooling table 16 which receives angle shape substrate 21 from shear 15. FIG. 14 illustrate stretch straightener 17. Following cooling, angle shaped substrate 21 will be delivered to stretch straightener 17 to straighten angled shape to be within precise standard tolerance allowance.

A formed structural product preferably has a thickness of no less than about 0.090 inches to about 1.500 inches and a width of about 1.000×1.000 to about 8.000×8.000 inches. Standard tolerance allowance according to ASTM for carbon steel are ASTM A36 for carbon steel and ASTM A276 and A479 for stainless steel.

In summary, the present invention has the advantage of reducing the number of conventional roll passes needed to form angle shaped structural members. Preferably, the present invention reduces the number of roll passes from the conventional nine pass flat and edging method to three roll passes thereby preventing heat loss in the rolling process. Prevention of heat loss enables rolling of light and thin angled sections that are difficult or impossible to roll by the conventional flat-and-edging or butterfly method.

While the invention has been described with reference to the preferred embodiment hereof, it will be appreciated by those of ordinary skill in the art that modification can be made to the structure and form of the invention without departing from the spirit and scope thereof.

We claim:

1. A method for forming structural members into a desired shape from a substrate, said substrate having a pair of edge surfaces and a top and bottom surface, comprising the steps of:

zone heating to a first predetermined temperature a center portion of said substrate located between its edges;

shaping said zone heated substrate with a plurality of edge guide rolls pushing on said pair of edge surfaces of said substrate to laterally move said center portion of said substrate towards a center of said top surface of said substrate;

heating said substrate to a second predetermined temperature; and hot shaping said heated substrate with a plurality of shape rolls for shaping said substrate into said desired shape.

2. The method of claim 1 wherein said cold shaping step further comprises;

at least one top roll and one bottom roll for rolling the top and the bottom of said substrate into said desired shape.

3. The method of claim 2 wherein said hot shaping step comprises:

three pairs of guide rolls with one of said guide rolls of each said pair positioned adjacent one of said edge surfaces and the other one of said guide rolls of each said pair positioned adjacent the opposite edge surface of said substrate.

4. The method of claim 3 further comprises the step of:

providing a source of a sheared plate bar flats of a predetermined length to form said substrate.

5. The method of claim 3 further comprising before said step of zone heating said portion of said substrate the step of:

sizing said substrate to a predetermined thickness and within 0.001 inch tolerance.

6. The method of claim 1 wherein said heating step is performed with induction heating.

7. The method of claim 1 where said heating step is performed with gas efficiency heating.

8. The method of claim 1 wherein said first predetermined temperature is in the range of about 1800 F. to about 2000 F.

9. The method of claim 1 wherein said step of shaping said zone heated substrate forms additional mass at said center of said substrate for providing mass and shape to form an apex section in said desired shape.

10. The method of claim 9 wherein said hot shaping step forms said apex section into an angle to form a structural member having an angled shape.

11. An apparatus for forming structural members into a desired shape from a substrate, said substrate having a pair of edge surfaces and a top and bottom surface, said apparatus comprising:

zone heating means for heating to a first predetermined temperature of a center portion of said substrate located between its edges;

shaping means for shaping said zone heated substrate with a plurality of edge guide rolls pushing on said edge surface of said substrate to laterally move said portion of said substrate towards a center portion of said top surface of said substrate;

means for heating said substrate to a second predetermined temperature; and hot shaping means for shaping with a plurality of shape rolls said substrate into said desired shape.

12. The apparatus of claim 11 wherein said cold shaping means further comprises, at least one top roll and one bottom roll rolling said top and bottom of said substrate.

13. The apparatus of claim 12 wherein said hot shaping means comprises:

three pairs of guide rolls with one of said guide rolls of each said pair positioned adjacent one of said edge surfaces and the other one of said guide rolls of each said pair positioned adjacent the opposite edge surface of said substrate.

14. The apparatus of claim 11 wherein said zone heating means comprises an induction heater.

15. The apparatus of claim 11 wherein said shaping means for shaping said zone heated substrate means forms additional mass at said center of said substrate for providing mass and shape to form an apex section in said desired shape.

* * * * *